US009316223B2

(12) United States Patent
Unami et al.

(10) Patent No.: US 9,316,223 B2
(45) Date of Patent: Apr. 19, 2016

(54) SCROLL EXPANDER WITH ADIABATIC LAYER

(71) Applicant: ANEST IWATA CORPORATION, Yokohama-shi, Kanagawa-ken (JP)

(72) Inventors: Atsushi Unami, Yokohama (JP); Tamotsu Fujioka, Yokohama (JP)

(73) Assignee: ANEST IWATA CORPORATION, Kanagawa-Ken (JP)

( * ) Notice: Subject to any disclaimer, the term of this patent is extended or adjusted under 35 U.S.C. 154(b) by 81 days.

(21) Appl. No.: 13/867,342

(22) Filed: Apr. 22, 2013

(65) Prior Publication Data

US 2013/0315767 A1 Nov. 28, 2013

(30) Foreign Application Priority Data

Apr. 25, 2012 (JP) ..... 2012-100017

(51) Int. Cl.

| | |
|---|---|
| ***F01C 1/02*** | (2006.01) |
| ***F01C 21/00*** | (2006.01) |
| ***F04C 18/02*** | (2006.01) |
| ***F04C 18/00*** | (2006.01) |
| ***F01C 21/06*** | (2006.01) |

(52) U.S. Cl.

CPC ..... *F04C 18/00* (2013.01); *F01C 1/0238* (2013.01); *F01C 21/06* (2013.01); *F04C 2240/603* (2013.01)

(58) Field of Classification Search

CPC .. F01C 1/0238; F01C 21/06; F04C 2240/603; F04C 18/0223

USPC ..... 413/55.1, 55.2

See application file for complete search history.

(56) References Cited

U.S. PATENT DOCUMENTS

| | | | | |
|---|---|---|---|---|
| 6,953,330 | B1 * | 10/2005 | Muto | 418/55.1 |
| 7,124,585 | B2 * | 10/2006 | Kim et al. | 418/55.1 |
| 2002/0150485 | A1 | 10/2002 | Mori et al. | |
| 2005/0220648 | A1 * | 10/2005 | Sato et al. | 418/55.1 |

(Continued)

FOREIGN PATENT DOCUMENTS

| | | | | |
|---|---|---|---|---|
| JP | 59034494 | A | 2/1984 | |
| JP | 06341381 | A * | 12/1994 | F04C 18/02 |
| JP | 6341381 | A | 12/1994 | |
| JP | 2002-310073 | A | 10/2002 | |
| JP | 2003-307188 | A | 10/2003 | |
| JP | 2004286025 | A | 10/2004 | |
| JP | 2009299653 | A | 12/2009 | |
| WO | 02/053916 | A1 | 7/2002 | |

OTHER PUBLICATIONS

Office Action mailed Dec. 11, 2015, corresponding to Japanese Patent Application No. 2012-100017.

Office Action mailed Dec. 11, 2015, corresponding to Japanese Patent Application No. 2012-100022.

*Primary Examiner* — Mary A Davis

(74) *Attorney, Agent, or Firm* — Hauptman Ham, LLP

(57) ABSTRACT

Provided is a double rotation type scroll expander, aiming at protecting a bearing that supports drive shaft a drive shaft and the like from the heat of a working medium when a working medium introduction hole is provided in the drive shaft. The working medium introduction hole is drilled into the drive shaft such that the high-temperature, high-pressure working medium is supplied to expansion chambers through the working medium introduction hole. An adiabatic sleeve that forms a part of the working medium introduction hole is attached to the drive shaft in an internal region of roller bearings that support the drive shaft and a driven scroll body rotatably. Heat transfer from the working medium to the roller bearings is suppressed by the adiabatic sleeve, whereby the roller bearings are prevented from deteriorating.

13 Claims, 3 Drawing Sheets

(56) References Cited

U.S. PATENT DOCUMENTS

2008/0206083 A1* 8/2008 Suefuji et al. ..... 418/55.4
2010/0254835 A1* 10/2010 Kane et al. ..... 418/55.1
2011/0300012 A1* 12/2011 Fujioka et al. ..... 418/55.1
2013/0302199 A1* 11/2013 Unami et al. ..... 418/55.2
2013/0309116 A1* 11/2013 Unami et al. ..... 418/55.1

* cited by examiner

SCROLL EXPANDER WITH ADIABATIC LAYER

RELATED APPLICATIONS

The present application is based on, and claims priority from, Japanese Application Number JP 2012-100017, filed Apr. 25, 2012, the disclosure of which is hereby incorporated by reference herein in its entirety.

BACKGROUND OF THE INVENTION

1, Field of the Invention

The present invention relates to a double rotation type scroll expander in which a drive scroll body integrated with a drive shaft and a driven scroll body rotate synchronously.

2, Description of the Related Art

Conventional power generation systems tend mostly to be large scale plants generating at least several hundred kW, while small scale power generation is performed mostly by simply structured engine power generators and the like. Recently, however, due to increased awareness of the need for energy conservation, passage of the Act on Special Measures Concerning Procurement of Renewable Electric Energy by Operators of Electric Utilities, and the like, a need and a market for small scale power generation are gradually increasing. Photovoltaic generation and wind force power generation, on the other hand, have not yet improved in cost-effectiveness. Meanwhile, a binary power generation system that uses hot water or steam at 75 to 150° C. as a heat source to drive a small scale power generator via a working medium having a low boiling point has been developed.

Amid these developments, a scroll expander, which exhibits little torque variation, has come to attract of attention as a favorable expander for use in a small scale power generation system. In a scroll type fluid machine, a compression chamber and an expansion chamber are formed in a crescent shape by end plates and spiral-shaped wraps of a pair of scroll bodies. Japanese Patent Application Publication No. 2009-299653 discloses a one-side revolving type scroll expander in which one of the pair of scroll bodies is a fixed scroll body and the other is a revolving scroll body, and the expansion chamber is formed by causing the revolving scroll body to revolve relative to the fixed scroll body. A scroll type fluid machine thus configured is dynamically sealed, and therefore noise and wear tend to increase in contact sites with the end plates and the wraps forming the expansion chamber, whereby a sealing property of the expansion chamber may be impaired.

Japanese Patent Application Publication No. H6-341381 discloses a double rotation type scroll fluid machine. In a double rotation type scroll fluid machine, a drive scroll body and a driven scroll body are rotated synchronously via an interlocking mechanism, and therefore noise and wear in the contact sites can be reduced. In the double rotation type scroll fluid machine, the compression chamber and the expansion chamber are formed by causing the driven scroll body to rotate eccentrically relative to the drive scroll body.

The double rotation type scroll fluid machine disclosed in Japanese Patent Application Publication No. H6-341381 has a so-called "double wrap scroll structure" in which the compression chamber or the expansion chamber is formed on both surface sides of an end plate of the driven scroll body. By forming the compression chamber or the expansion chamber on both sides in this manner, a high-pressure fluid supply amount and an output (a rotary torque) can be increased. Further, a thrust direction load exerted on the drive scroll body and the driven scroll body can be canceled out, and therefore a support structure for the drive scroll body and the driven scroll body can be simplified.

Japanese Patent Application Publication No. S59-34494 discloses a configuration of a scroll type fluid machine having a fixed scroll body and a revolving scroll body in which an adiabatic material is buried in the end plate of the revolving scroll body. In so doing, heat transfer from the compression chamber and the expansion chamber to a bearing that supports a drive shaft of the revolving scroll body can be prevented. Japanese Patent Application Publication No. 2004-286025 discloses a configuration in which a fan blade is formed on the endplate of the drive scroll body, and an interior of a housing is cooled by introducing cooling air into the housing from the outside using the fan blade.

In a scroll expander, the drive shaft is rotated by an expansion force of a high-temperature, high-pressure working medium supplied to the expansion chamber. Therefore, when a leak of the working medium or pre-expansion due to a temperature reduction in the working medium occurs before the working medium is supplied to the expansion chamber, the output (the rotary torque) of the drive shaft decreases. To obtain a high output, therefore, it is necessary to prevent pre-expansion by improving a sealing property of a supply passage that supplies the working medium to the expansion chamber. In the case of a double rotation type scroll expander, however, the drive scroll body and the driven scroll body rotate in conjunction with each other, and it is therefore not easy to secure a working medium supply passage. With a scroll expander having a double wrap scroll structure in particular, the working medium must be introduced into double expansion chambers, making it even more difficult to secure a supply passage.

When the scroll compressor disclosed in Japanese Patent Application Publication No. H6-341381 is used as an expander, the high-temperature, high-pressure working medium is supplied to the expansion chamber through an introduction hole provided in the drive shaft. With this supply method, however, a bearing that supports the drive shaft and the driven scroll body rotatably may deteriorate due to exposure to the heat of the working medium, whereby the lifespan of the bearing and grease sealed inside the bearing may decrease.

SUMMARY OF THE INVENTION

In consideration of these problems, an object of the present invention is to provide a double rotation type scroll expander with which a bearing that rotatably supports a drive shaft and the like can be protected from heat from a working medium, thereby preventing deterioration of the bearing and grease sealed inside the bearing, when a working medium introduction hole is provided in the drive shaft.

To achieve this object, a scroll expander according to the present invention includes: a drive shaft; a drive scroll body provided integrally with the drive shaft; a driven scroll body having a rotary axis that is eccentric relative to a rotary axis of the drive shaft; an interlocking mechanism that causes the drive scroll body and the driven scroll body to rotate synchronously; and a bearing that supports the drive shaft and the driven scroll body rotatably relative to a fixed frame. The driven scroll body is caused to rotate synchronously with the drive scroll body by the interlocking mechanism, and a crescent-shaped expansion chamber is formed by the drive scroll body and the driven scroll body.

Further, a working medium introduction hole that opens onto a radial direction central portion of the expansion chamber is provided in the drive shaft, and an adiabatic layer is provided in a region between the bearing and the working medium introduction hole so as to surround the working medium introduction hole. Thus, heat transfer from the working medium to the bearing can be suppressed by the adiabatic layer such that the bearing and grease sealed inside the bearing are prevented from deteriorating, whereby a shortening in the lifespan of these components can be prevented. Adiabatic layer may be composed of, for example, fluororesin having a thermal insulation property and a heat resistance property, or another type of engineering plastic having a thermal insulation property. Alternatively, a sleeve made of a different type of metal from the material of the drive shaft may be attached to the drive shaft. In so doing, heat transfer between the drive shaft and the region between the bearing and the working medium can be suppressed, whereby heat transfer to the bearing can be suppressed.

The adiabatic layer is preferably disposed such that an inner surface thereof opposes the working medium introduction hole, and provided consecutively with a region of the working medium introduction hole that is adjacent to the adiabatic layer such that no step is formed. Thus, the adiabatic layer contacts the working medium directly, and therefore the drive shaft and the bearing disposed on the outer side of the adiabatic layer can be protected from the heat of the working medium. Further, since a step is not formed in the working medium introduction hole on the boundary with the adiabatic layer, a flow of the working medium is not disturbed, and therefore pressure loss does not occur. As an alternative configuration for the adiabatic layer, an adiabatic cylindrical collar may be attached to an outer peripheral surface of the drive shaft on the bearing inner side.

In addition to the adiabatic layer, when the bearing is housed in a casing, a cooling fin is preferably formed on an outer surface of the casing. A cooling effect on the bearing can be promoted further by the cooling effect of the cooling fin.

In the scroll expander to which the present invention is applied, when a housing is provided to house the drive scroll body and the driven scroll body, the drive shaft is preferably constituted by a single integrated drive shaft penetrating an internal region of the housing, the drive scroll body preferably includes two first end plates disposed on both sides of the driven scroll body and a spiral-shaped first wrap that projects inward respectively from the two first end plates, the driven scroll body preferably includes a second end plate disposed between the two first end plates and a second wrap projecting from respective surfaces of the second end plate, and the expansion chamber is preferably formed on both sides of the second endplate by the first end plates, the second end plate, the first wrap, and the second wrap.

In the scroll expander thus configured, a double expansion chamber is formed, and therefore an output (a rotary torque) can be increased. Further, a thrust direction load exerted on the drive scroll body and the driven scroll body can be canceled out, and therefore a support structure for the drive scroll body and the driven scroll body can be simplified. Furthermore, the drive shaft is constituted by the single drive shaft penetrating the internal region of the housing, and therefore axial alignment of the drive shaft in the interior of the housing is not required. Moreover, by forming the working medium introduction hole in the drive shaft thus configured, a sealing performance can be improved, and pre-expansion due to a reduction in the temperature of the working medium can be eliminated. Accordingly, high-pressure working medium can be supplied to the expansion chamber, whereby the output can be increased. Furthermore, positioning of an opening of the working medium introduction hole provided in the double expansion chamber can be facilitated, and the working medium can be supplied to the respective expansion chambers evenly since the opening position can be selected as desired.

In another configuration of the scroll expander described above, instead of the single integrated penetrating shaft penetrating the interior of the housing, the drive shaft is preferably constituted by a first drive shaft and a second drive shaft disposed coaxially, one of the first drive shaft and the second drive shaft being joined to one of the two first end plates of the drive scroll body and the other being joined to the other of the two first end plates, and the working medium introduction hole is preferably drilled into the first drive shaft or the second drive shaft.

With the drive shaft thus configured, the drive shaft can be excluded from a central portion of the expansion chamber, and therefore a space for securing the expansion chamber can be increased correspondingly. Accordingly, an expansion ratio of the working medium in the expansion chamber can be increased, whereby the output of the scroll expander can be increased.

In the double rotation type scroll expander according to the present invention, the working medium introduction hole is drilled into the drive shaft so as to open onto the radial direction central portion of the expansion chamber, and the adiabatic layer is formed in the region between the bearing that rotatably supports the drive shaft and the like and the working medium introduction hole so as to surround the working medium introduction hole. Thus, heat transfer from the working medium to the bearing can be suppressed by the adiabatic layer, whereby deterioration and a lifespan shortening in the bearing and grease sealed inside the bearing can be prevented.

DESCRIPTION OF THE PREFERRED EMBODIMENTS

Embodiments of the present invention will be described in detail below with reference to the drawings. However, it should be noted that unless specific description is provided to the contrary, dimensions, materials, shapes, relative arrangements, and the like of constituent components described in the embodiments are not intended to limit the scope of the present invention.

(First Embodiment)

Figure 1:
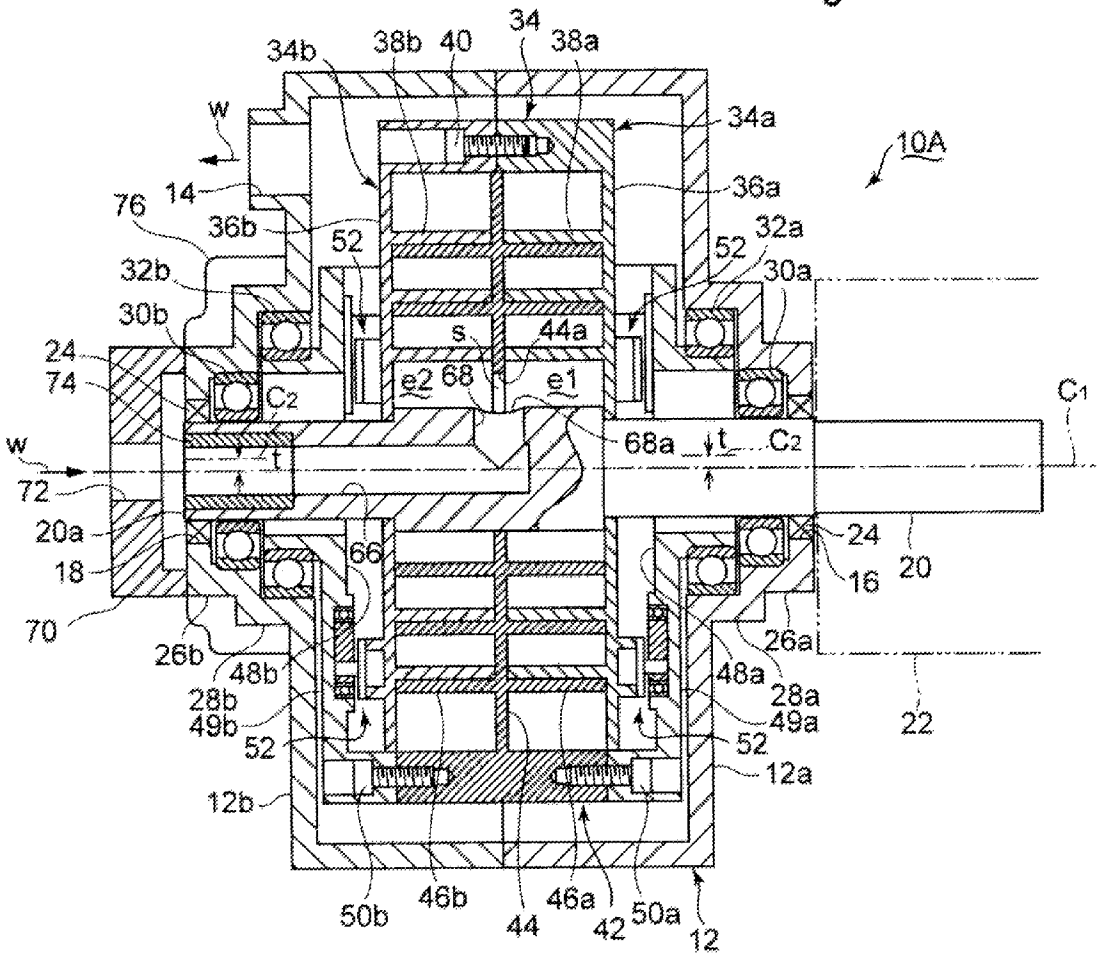
FIG. 1 is a front sectional view of a scroll expander according to a first embodiment of the present invention.
Figure 2:
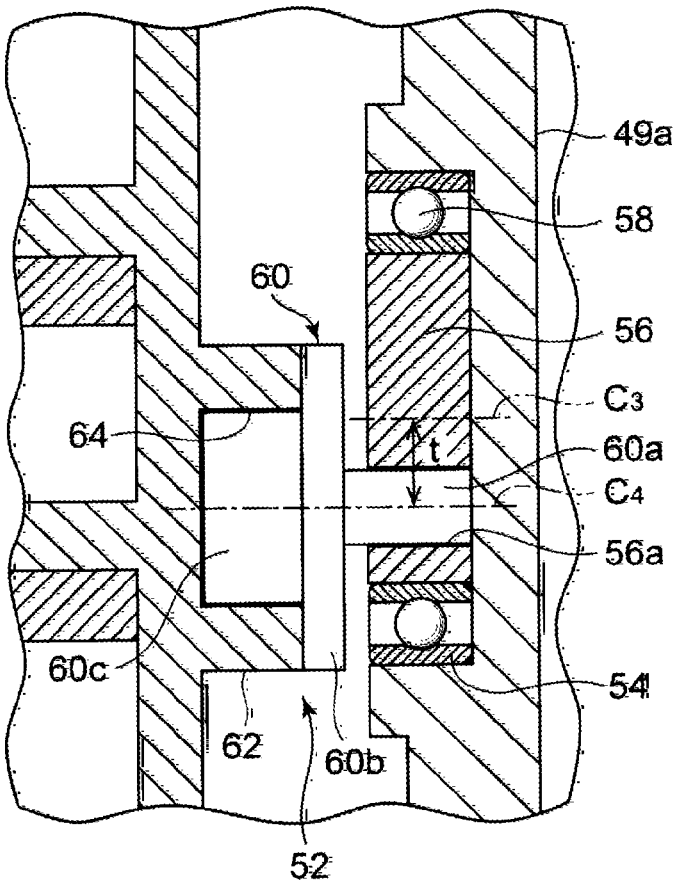
FIG. 2 is a partially enlarged view of FIG. 1.

A first embodiment of the present invention will now be described on the basis of FIGS. 1 and 2. A scroll expander according to this embodiment may be applied to the binary power generation system described above, for example. In this power generation system, a pressurized low-boiling point working medium is introduced into the scroll expander, a drive shaft is rotated using an expansion force of the working medium, and power is generated by a power generator connected to the drive shaft of the scroll expander. In FIG. 1, a housing 12 of a scroll expander 10A is constituted by a pair of casings 12*a* and 12*b* forming a hollow cylinder. Respective end portions of the casings 12*a* and 12*b* are butted together such that a hollow space is formed in the interior. A discharge port 14 that discharges an expanded working medium w to the exterior of the housing 12 is provided in a site on an end surface outer peripheral side of the casing 12*b*.

Openings 16 and 18 are formed on a central axis of the casings 12*a* and 12*b*, and a drive shaft 20 having a circular cross-section is disposed to penetrate the openings. A power generator 22 is provided on one end of the drive shaft 20 to be capable of generating power in response to rotation of the drive shaft 20. Sealing packing 24 is inserted between the drive shaft 20 and the openings 16 and 18. Step portions 26*a*, 28*a* and 26*b*, 28*b* are formed on the casings 12*a*, 12*b* in the vicinity of the openings 16, 18, and roller bearings 30*a*, 32*a* and 30*b*, 32*b* are disposed on an inner side of the step portions 26*a*, 28*a* and 26*b*, 28*b*.

A drive scroll body 34 is joined integrally to the drive shaft 20. The drive scroll body 34 is constituted by a pair of divided scroll bodies 34*a* and 34*b*, The divided scroll body 34*a* is constituted by an annular end plate 36*a* and a spiral wrap 38*a* that stands upright from the end plate 36*a* in a perpendicular direction thereto, and an inner peripheral edge of the end plate 36*a* is joined to the drive shaft 20. The divided scroll body 34*b* is constituted by an annular end plate 36*b* and a spiral wrap 38*b* that stands upright from the end plate 36*b* in a perpendicular direction thereto, and an inner peripheral edge of the end plate 36*b* is joined to the drive shaft 20. Respective outer peripheral portions of the divided scroll bodies 34*a* and 34*b* are joined to each other by a bolt 40. An interval into which an end plate 44 of a driven scroll body 42, to be described below, can be inserted is provided between respective tip ends of the wraps 38*a* and 38*b*.

The driven scroll body 42 is constituted by the circular endplate 44, which is disposed between the wraps 38*a*, 38*b*, two spiral wraps 46*a* and 46*b* standing upright from respective surfaces of the end plate 44 in a perpendicular direction thereto, and boss portions 48*a* and 48*b* disposed on the periphery of the drive shaft 20 on an outer side of the end plates 36*a*, 36*b*, An arm 49*a* is provided integrally with the boss portion 48*a* to extend in a single direction from the boss portion 48*a*, and the arm 49*a* is joined to an outer peripheral portion of the wrap 46*a* by a bolt 50*a*, Similarly, an arm 49*b* is provided integrally with the boss portion 48*b* to extend in a single direction from the boss portion 48*b*, and the arm 49*b* is joined to an outer peripheral portion of the wrap 46*b* by a bolt 50*b*, whereby expansion chambers e1 and e2 are formed on respective sides of the end plate 44 by the end plates 36*a*, 36*b*, 44 and the wraps 38*a*, 38*b*, 46*a*, 46*b* of the drive scroll body 34 and the driven scroll body 42.

The drive shaft 20 is supported by the roller bearings 30*a* and 30*b* rotatably. The boss portion 48*a* of the driven scroll body 42 is supported by the roller bearing 32*a* rotatably, and the boss portion 48*b* is supported by the roller bearing 32*b* rotatably. A rotary axis $C_2$ of the boss portions 48*a* and 48*b* is eccentric from a rotary axis $C_1$ of the drive shaft 20 by t. Therefore, the driven scroll body 42 rotates in a position that is eccentric from the drive shaft 20 by t.

The drive scroll body 34 and the driven scroll body 42 rotate in synchronization with each other via an interlocking mechanism 52. Four interlocking mechanisms 52, for example, are provided at equal intervals on the periphery of the drive shaft 20. A configuration of the interlocking mechanism 52 will now be described with reference to FIG. 2, taking as an example the interlocking mechanism 52 provided between the boss portion 48*a* and the divided scroll body 34*a*, In FIG. 2, a cylindrical recessed portion 54 is engraved into the arm 49*a* that opposes the divided scroll body 34*a*, A short axis cylinder 56 is inserted into the recessed portion 54, and a roller bearing 58 is interposed between the short axis cylinder 56 and the recessed portion 54. The roller bearing 58 allows the short axis cylinder 56 to rotate freely within the recessed portion 54.

A circular hole 56*a* is drilled into the short axis cylinder 56 in a region eccentric from a central axis $C_3$, and a circular pin 60*a* forming a pin structure 60 is press-fitted into the hole 56*a*, The pin structure 60 is formed integrally from the pin 60*a*, a large-diameter disc 60*b*, and a cylindrical base portion 60*c*, A boss portion 62 is formed to project from an outer surface of the end plate 36*a* opposing the short axis cylinder 56, and a cylindrical recessed portion 64 is formed in the boss portion 62. The base portion 60*c* of the pin structure 60 is press-fitted into the recessed portion 64. A central axis $C_4$ of the pin 60*a* is eccentric from the central axis $C_3$ of the short axis cylinder 56 by an eccentric amount t. The eccentric amount t is identical to the eccentric amount t between the rotary axis $C_1$ of the drive shaft 20 and the rotary axis $C_2$ of the boss portion 48*a*.

A working medium introduction hole 66 is drilled into the drive shaft 20 in an axial direction. One end of the working medium introduction hole 66 opens onto an end surface 20*a* of the drive shaft 20, and a radial direction hole 68 is formed consecutively with the other end. An opening 68*a* of the radial direction hole 68 opens onto a central portion of the expansion chambers e1 and e2. A recessed portion 44*a* is formed in the end plate 44 in a site opposing the drive shaft 20 to allow conjunct eccentric motion of the driven scroll body 42 relative to the drive shaft 20, and a gap s is formed between the recessed portion 44*a* and the drive shaft 20. The opening 68*a* opens onto the gap s in an intermediate position between the end plates 36*a* and 36*b* so as to straddle the end plate 44 evenly. Further, a cover 70 is provided on the end surface 20*a* of the drive shaft 20, and a working medium introduction hole 72 is provided in the cover 70.

In a region on the inner side of the roller bearings 30*b* and 32*b*, a cylindrical adiabatic sleeve 74 is attached to an inner peripheral surface of the drive shaft 20 opposing the working medium introduction hole 66. The adiabatic sleeve 74 is made from a fluororesin material having a thermal insulation property and a heat resistance property. A boundary between the working medium introduction hole 66 and the adjacent adiabatic sleeve 74 takes the form of a curved surface not having a step. Further, a plurality of cooling fins 76 are provided on an outer peripheral surface of the step portions 26*b* and 28*b* of the housing 12. The plurality of cooling fins 76 extend in the axial direction of the drive shaft 20, and are disposed radially at intervals.

With this configuration, when the high-temperature, high-pressure working medium w is introduced into the expansion chambers e1 and e2 through working medium introduction holes 72 and 66 via the radial direction hole 68, rotary torque is exerted on the drive scroll body 34 and the drive shaft 20 by the expansion force of the working medium w, causing the drive shaft 20 to rotate. When the drive scroll body 34 rotates, the driven scroll body 42 rotates synchronously via the interlocking mechanism 52. When the drive shaft 20 rotates, the power generator 22 connected to the drive shaft 20 generates power. After expanding in the expansion chambers e1, e2, the working medium w is discharged to the outside of the housing 12 through the discharge port 14.

According to this embodiment, the adiabatic sleeve 74 is attached to the periphery of the working medium introduction hole 66 formed in the drive shaft 20 in the region on the inner side of the roller bearings 30*b* and 32*b*, and therefore heat transfer from the working medium w to the roller bearings 30*b* and 32*b* can be suppressed, whereby the roller bearings 30*b*, 32*b* and grease sealed in the interior of the roller bearings

30*b*, 32*b* can be prevented from deteriorating, thereby preventing a shortening in the lifespan of these components. Moreover, by providing the plurality of cooling fins 76 on the outer peripheral surface of the step portions 26*b* and 28*b* of the housing 12, a cooling effect on the roller bearings 30*b* and 32*b* can be further improved.

Furthermore, the two expansion chambers e1, e2 are formed, and therefore a supply amount of the working medium w can be increased, leading to an increase in the rotary torque exerted on the drive shaft 20, whereby an amount of power generated by the power generator 22 can be increased. Moreover, the expansion chambers e1, e2 are formed on both sides of the end plate 44, and therefore a thrust force exerted on the drive scroll body 34 and the driven scroll body 42 can be canceled out, whereby a support structure for the drive scroll body 34 and the driven scroll body 42 can be simplified.

Further, the drive shaft 20 is constituted by a single integrated drive shaft penetrating the double expansion chambers e1, e2, and therefore axial alignment is not required. Moreover, by providing the working medium introduction hole 66 in this penetrating shaft, an introduction hole which exhibits a favorable sealing property and in which pre-expansion due to a temperature reduction does not occur can be formed. Hence, the high-pressure working medium w can be supplied to the double expansion chambers e1, e2 such that a reduction in the output of the scroll expander 10A does not occur. Furthermore, by forming the drive shaft 20 from a single penetrating shaft, positioning of the radial direction hole 68 can be facilitated, and by providing the opening 68*a* of the radial direction hole 68 to open onto the gaps in a position straddling the endplate 44 evenly, the working medium w can be supplied to the expansion chambers e1 and e2 evenly. Hence, only the single opening 68*a* need be provided, and therefore the machining man-hour to form the radial direction hole 68 can be reduced.

Further, by employing the simply configured interlocking mechanism 52, an amount of torque required to rotate the drive scroll body 34 and the driven scroll body 42 can be reduced, enabling a corresponding increase in the amount of power generated by the power generator 22. Furthermore, the boss portions 48*a*, 48*b* of the driven scroll body 42 and the end plates 36*a*, 36*b* are joined via the arms 49*a*, 49*b*, and therefore a housing that covers an entire expansion chamber formation region, such as that described in Japanese Patent Application Publication No. H6-341381, is not required, whereby a weight of the driven scroll body 42 can be reduced, enabling a reduction in an amount of driving force required to rotate the driven scroll body 42 and a corresponding increase in the amount of power generated by the power generator 22. Note that in this embodiment, the drive shaft 20 is a penetrating shaft, and therefore a large expansion ratio cannot be secured in the expansion chambers e1, e2. However, in a binary power generation system, a large expansion ratio is not necessary.

(Second Embodiment)

Figure 3:
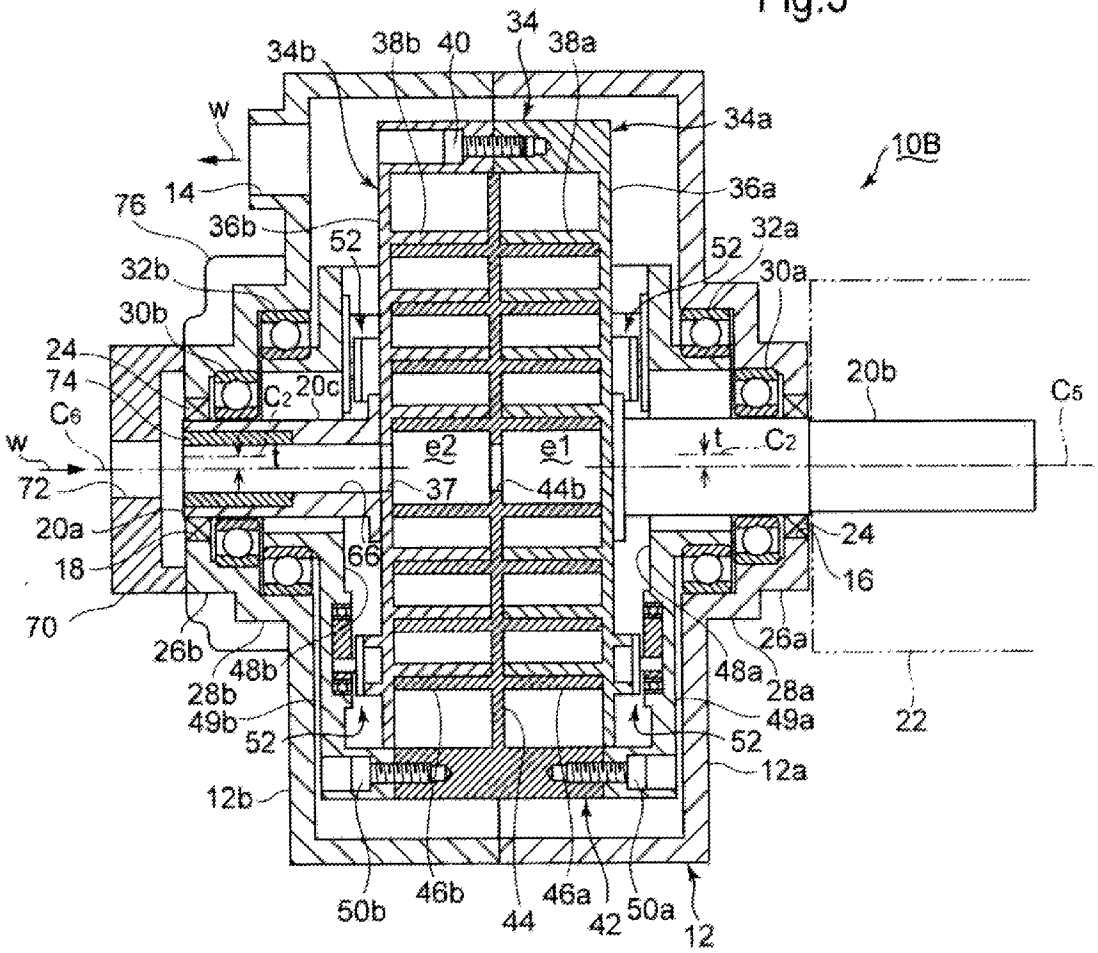
FIG. 3 is a front sectional view of a scroll expander according to a second embodiment of the present invention.

Next, a second embodiment of the present invention will be described using FIG. 3. In a scroll expander 10B according to this embodiment, the drive shaft is divided into a first drive shaft 20*b* and a second drive shaft 20*c*, The first drive shaft 20*b* is coupled to the end plate 36*a* of the drive scroll body 34. The second drive shaft 20*c* is coupled to the endplate 36*b* of the drive scroll body 34. The first drive shaft 20*b* and the second drive shaft 20*c* are disposed such that respective central axes $C_5$ and $C_6$ thereof are aligned. An opening 37 that connects the working medium introduction hole 66 to the expansion chamber e2 is provided in a central portion of the end plate 36*b*, and an opening 44*b* that connects the expansion chamber e1 to the expansion chamber e2 is provided in the endplate 44. All other configurations are identical to the first embodiment.

With this configuration, the high-temperature, high-pressure working medium w enters the expansion chamber e2 through the working medium introduction holes 72 and 66 via the opening 37, and then enters the expansion chamber e1 from the expansion chamber e2 through the opening 44*b*, The expansion force of the working medium w entering the expansion chambers e1, e2 causes the drive scroll body 34, and also the first drive shaft 20*b* and the second drive shaft 20*c*, to rotate. When the drive scroll body 34 rotates, the driven scroll body 42 rotates in response via the interlocking mechanism 52 while remaining eccentric to the drive scroll body 34. When the drive shaft 20*b* rotates, the power generator 22 connected to the drive shaft 20*b* generates power. After expanding in the expansion chambers e1, e2, the working medium w is discharged to the outside of the housing through the discharge port 14.

According to this embodiment, the drive shaft is not present in a central portion of the drive scroll body 34 and the driven scroll body 42, and therefore the expansion chambers e1 and e2 can be formed here, enabling an increase in the expansion ratio of the working medium w. Accordingly, the output of the scroll expander 10B can be increased, whereby the amount of power generated by the power generator 22 can be increased.

According to the present invention, when a high-temperature, high-pressure working medium is introduced into a double rotation type scroll expander through an introduction hole provided in a drive shaft, deterioration of a bearing that rotatably support the drive shaft and the like can be suppressed.

What is claimed is:

1. A scroll expander comprising:

a drive shaft;

a drive scroll body provided integrally with the drive shaft;

a driven scroll body having a rotary axis that is eccentric relative to a rotary axis of the drive shaft;

an interlocking mechanism that causes the drive scroll body and the driven scroll body to rotate synchronously; and a bearing that supports the drive shaft and the driven scroll body rotatably relative to a housing, wherein an expansion chamber is formed by the drive scroll body and the driven scroll body, a working medium introduction hole that extends in an axial direction along the center of the drive shaft and opens in a radial direction perpendicular to the axial direction, into a central portion of the expansion chamber is provided in the drive shaft, and an adiabatic layer is provided in a region between the bearing and the working medium introduction hole so as to surround the working medium introduction hole.

2. The scroll expander according to claim 1, wherein the adiabatic layer is disposed such that an inner surface thereof faces the working medium introduction hole, and the inner surface of the adiabatic layer is provided consecutively with an inner surface of the drive shaft.

3. The scroll expander according to claim 1, wherein the housing is a casing that houses the bearing, and a cooling fin is formed on an outer surface of the casing.

4. The scroll expander according to claim 1, wherein the housing is provided to house the drive scroll body and the driven scroll body, the drive shaft is constituted by a single integrated drive shaft penetrating an internal region of the housing, the drive scroll body includes two first end plates disposed on both sides of the driven scroll body and a spiral-shaped first wrap that projects inward respectively from the two first end plates, the driven scroll body includes a second end plate disposed between the two first end plates and a second wrap projecting from respective surfaces of the second end plate, and the expansion chamber is formed on both sides of the second end plate by the first end plates, the first wrap, the second end plate, and the second wrap.

5. The scroll expander according to claim 1, wherein the drive scroll body includes two first end plates disposed on both sides of the driven scroll body and a spiral-shaped first wrap that projects inward from the two first end plates, the driven scroll body includes a second end plate disposed between the two first end plates and a second wrap projecting from respective surfaces of the second end plate, two expansion chambers are formed on respective sides of the second end plate by the first end plates, the first wrap, the second end plate, and the second wrap, the drive shaft is constituted by a first drive shaft and a second drive shaft disposed coaxially, one of the first drive shaft and the second drive shaft being joined to one of the two first end plates of the drive scroll body and the other of the first drive shaft and the second drive shaft being joined to the other of the two first end plates, and the working medium introduction hole is drilled into the first drive shaft or the second drive shaft.

6. The scroll expander according to claim 1, wherein the adiabatic layer is disposed such that an inner surface thereof defines the working medium introduction hole, and the inner surface of the adiabatic layer is provided consecutively with an inner surface of the drive shaft.

7. The scroll expander according to claim 1, further comprising an additional expansion chamber.

8. The scroll expander according to claim 1, further comprising an additional expansion chamber, wherein the expansion chamber and the additional expansion chamber collectively establish a double expansion chamber.

9. The scroll expander according to claim 1, further comprising an additional expansion chamber, wherein the expansion chamber and the additional expansion chamber are in fluid communication with the working medium introduction hole.

10. The scroll expander according to claim 1, further comprising an additional expansion chamber, wherein the expansion chamber and the additional expansion chamber share a common wall in which an opening is located.

11. The scroll expander according to claim 1, further comprising an additional expansion chamber, wherein the expansion chamber and the additional expansion chamber share a common wall in which an opening is located, the opening providing fluid communication between the chambers.

12. The scroll expander according to claim 1, further comprising an additional expansion chamber and an end plate, the expansion chamber and the additional expansion chamber collectively forming a double expansion chamber, wherein the working medium introduction hole opens in a single central location that straddles the end plate evenly.

13. The scroll expander according to claim 1, further comprising an additional expansion chamber, wherein the expansion chamber and the additional expansion chamber share a common wall centered at an end of the working medium introduction hole.

* * * * *